US008210347B2

(12) United States Patent
McLaughlin

(10) Patent No.: US 8,210,347 B2
(45) Date of Patent: Jul. 3, 2012

(54) UNIVERSAL LIPSTICK REFILL CASE

(76) Inventor: Olive Anne McLaughlin, Dallas, TX (US)

( * ) Notice: Subject to any disclaimer, the term of this patent is extended or adjusted under 35 U.S.C. 154(b) by 25 days.

(21) Appl. No.: 12/683,373

(22) Filed: Jan. 6, 2010

(65) Prior Publication Data

US 2010/0108553 A1 May 6, 2010

Related U.S. Application Data

(63) Continuation-in-part of application No. 12/184,393, filed on Aug. 1, 2008, now abandoned.

(51) Int. Cl.

| | |
|---|---|
| ***B65D 85/72*** | (2006.01) |
| ***B65D 85/30*** | (2006.01) |
| ***A45D 40/04*** | (2006.01) |
| ***A45D 40/20*** | (2006.01) |

(52) U.S. Cl. ..... 206/385; 206/581; 401/68; 401/88

(58) Field of Classification Search ..... 206/385, 206/581; 401/68, 88

See application file for complete search history.

(56) References Cited

U.S. PATENT DOCUMENTS

| | | | | | |
|---|---|---|---|---|---|
| 1,557,608 | A | | 10/1925 | Perkins | |
| 2,094,006 | A | * | 9/1937 | O'Moore-Farrell | 132/318 |
| 2,099,122 | A | * | 11/1937 | Kreisler | 132/303 |
| 2,302,473 | A | * | 11/1942 | Reichenbach | 401/78 |
| 2,458,020 | A | * | 1/1949 | Olsen | 132/316 |
| 2,650,597 | A | * | 9/1953 | Girard | 206/385 |
| 2,937,680 | A | * | 5/1960 | Dumas | 150/116 |
| 3,146,881 | A | | 9/1964 | Metreaud et al. | |
| 3,214,012 | A | * | 10/1965 | Mack | 206/385 |
| 3,653,776 | A | * | 4/1972 | Geisel | 401/86 |
| 4,555,020 | A | * | 11/1985 | Campello et al. | 206/235 |
| 4,888,667 | A | * | 12/1989 | Hwang | 206/235 |
| 4,905,128 | A | * | 2/1990 | Caires | 362/109 |
| 5,399,040 | A | * | 3/1995 | Holloway | 401/78 |
| 5,605,408 | A | | 2/1997 | Su | |
| 5,765,683 | A | | 6/1998 | Starkle | |
| 5,871,295 | A | | 2/1999 | Bouix | |
| 6,030,136 | A | | 2/2000 | Bennett et al. | |
| 6,158,911 | A | | 12/2000 | Seebach, Jr. et al. | |
| 2005/0183984 | A1 | * | 8/2005 | Shih | 206/581 |

FOREIGN PATENT DOCUMENTS

| | | |
|---|---|---|
| GB | 925270 | 5/1963 |

OTHER PUBLICATIONS

International Search Report dated Mar. 17, 2011 for PCT Application Serial No. PCT/US11/20279; 2 pages.

Written Opinion dated Mar. 17, 2011 for PCT Application Serial No. PCT/US11/20279; 4 pages.

* cited by examiner

*Primary Examiner* — J. Gregory Pickett
*Assistant Examiner* — Kaushikkumar Desai
(74) *Attorney, Agent, or Firm* — Klemchuk Kubasta LLP

(57) ABSTRACT

The present disclosure could generally provide a reusable and universal case for personal items such as, for example, removable lipstick refills. Manufacturers could provide relatively cost-effective lipstick refills suitable for use with a more elegantly packaged and fully functional universal case. The case could include an elongated tube to house a lipstick refill. The case could also include a notch disposed on an interior surface of an elongated tube to receive a groove disposed on an exterior surface of an insert disposed within a second end of the tube. The case could further include a protrusion on an interior surface of the insert that is disposed along a surface of the lipstick refill.

16 Claims, 3 Drawing Sheets

UNIVERSAL LIPSTICK REFILL CASE

CROSS REFERENCE TO RELATED APPLICATIONS

This application claims benefit under 35 U.S.C. §120 of co-pending U.S. patent application Ser. No. 12/184,393 filed on Aug. 1, 2008 in the United States Patent and Trademark Office entitled "Individual and Universal Lipstick Tube Cases." The entire disclosure of U.S. patent application Ser. No. 12/184,393 is incorporated by reference as if fully disclosed herein.

This application also claims benefit under 35 U.S.C. §119 (e) of U.S. Provisional Patent Application Ser. No. 60/953,751 filed on Aug. 14, 2007 in the United States Patent and Trademark Office entitled "Individual and Universal Lipstick Tube Cases." The entire disclosure of U.S. Provisional Patent Application Ser. No. 60/953,751 is incorporated by reference as if fully disclosed herein.

The disclosure relates generally to cosmetic related products and, in particular, to lipstick cases and related accessories and paraphernalia.

BACKGROUND

Currently available lipstick tubes comprise a wide variety of sizes and styles. Each manufacturer has its own signature design for its lipstick tubes, generally comprising a base and a cover received thereon. Most lipstick tubes are metallic or plastic and comprise a simple appearance. Once a lipstick has been used or is no longer needed, the entire lipstick tube is typically thrown away. Women often desire a more fashionable appearance for their lipstick tubes and could be persuaded to invest in certain environmentally friendly options.

SUMMARY

Embodiments of the present disclosure generally provide a universal case for a lipstick refill.

In one embodiment, the present disclosure could generally provide a universal case for a lipstick refill. The case could include an elongated tube having a first end and a second end. The case could also include an insert disposed within the second end to retain a lipstick refill. A rotation of the second end relative to the lipstick refill could change a relative disposition of the lipstick refill.

In one embodiment, the present disclosure could generally provide a universal case for a lipstick refill. The case could include an elongated tube to house a lipstick refill. The tube could include a first end and a second end. The rotation of the second end relative to the lipstick refill could change a relative disposition of the lipstick refill within the elongated tube.

In one embodiment, the present disclosure could generally provide a universal case for a lipstick refill. The case could include an elongated tube to house a lipstick refill. The case could also include a notch disposed on an interior surface of the tube to receive a projection disposed on an exterior surface of an insert disposed within a second end of the tube. The case could further include a protrusion on an interior surface of the insert disposed along a surface of the lipstick refill.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The present disclosure generally provides a universal case for a lipstick refill. The universal case could retain or otherwise secure a variety of different lipsticks, a particular company or brand of lipstick tubes, any suitable lipstick tube, refill, related container, or the like, or any combination thereof. It should be understood that the case could be reusable and thus provide an environmentally friendly solution over conventional lipstick tube systems and methods. In addition, the case could be embellished or customized as desired according to one embodiment of the present disclosure.

Figure 1:
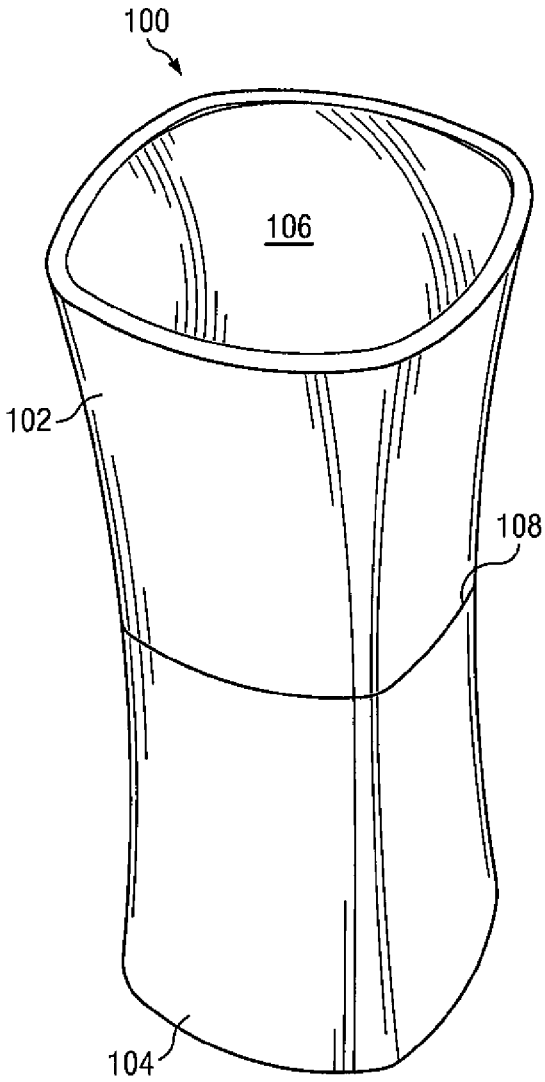
FIG. 1 is a somewhat simplified illustration of a reusable case for a lipstick refill or other personal item according to one embodiment of the present disclosure.

FIG. 1 is a somewhat simplified illustration of case 100 for housing a lipstick refill or other personal item according to one embodiment of the present disclosure. It should be understood that case 100 shown in FIG. 1 is for illustrative purposes only and that any other suitable system or subsystem could be used in conjunction with or in lieu of case 100 according to one embodiment of the present disclosure.

Case 100 could include first end 102, second end 104, accessory 106, edge 108, and one or more notches 210*a* (later shown in FIG. 2A) according to one embodiment of the present disclosure. Case 100 could be used to house, hold, retain, secure, transport, handle, or otherwise engage with, couple to, or be disposed about a personal item such as, for example, a lipstick refill, tube, or related container. In one embodiment, the lipstick refill could include a base and a lipstick color, but not necessarily include a tube to house the base and/or the lipstick color, or a rotating mechanism to rotate the base.

In one embodiment, case 100 could be any suitably sized, shaped, or configured case, cover, or housing for lipstick refills. For example, case 100 could be a long, short, or medium sized casing. Case 100 could also be a generally round, square, hexagonal, concave, convex, hour-glass, or other suitably shaped case.

In one embodiment, case 100 could be used to provide a reusable, removable, and adjustable "case" for the personal item. For example, manufacturers could provide lipstick refills suitable for use with case 100 instead of manufacturing and selling an entire lipstick tube having a case, lipstick applicator, and twist-up mechanism. In other examples, manufacturers could provide lipstick refills with cheaper or lower quality tubes or cases (e.g., refills with a non-rotatable base) suitable for use with a more elegantly packaged and fully functional case 100.

Although the following description primarily describes case 100 for use in conjunction with a lipstick refill, tube, cartridge, or related container, it should be understood that case 100 could be used with any suitably sized, shaped, or configured refill, cartridge, tube, container, or other apparatus used to house, hold, retain, secure, transport, handle, or otherwise engage with, couple to, or be disposed about any suitable material including, for example, lip balm, lip gloss, lip protectant, cream foundation, foundation, cream powder, powder, concealer, cream blush, blush, cream eye shadow, eye shadow, make-up, perfume, deodorant, touch-up stick, sunscreen, brush, cosmetic item, other suitable materials, liquids, semi-liquids, solids, semi-solids, gels, creams, sprays, grooming devices, personal item, other cosmetic item, or any combination thereof. In one embodiment, the lipstick refill could be any suitably sized, shaped, or configured object. For example, the lipstick refill could be a long, short, or medium sized casing. The lipstick refill could also be a generally round, square, hexagonal, concave, convex, hourglass, or other suitably shaped object.

In one embodiment, first end 102 and second end 104 could be configured to removably couple to or dispose about respective ends of a container according to one embodiment of the present disclosure. When properly installed, case 100 could be used to control the lipstick container housed within case 100. For example, second end 104 could be coupled to or disposed about a first end of a lipstick refill (e.g., the part of the lipstick refill generally used to hold or retain the lipstick or applicator), while the first end 102 could be coupled to another end of the same lipstick refill. Accordingly, a user could, for example, simply twist second end 104 to operate a standard twist-operated (or twist-up) lipstick refill properly housed in case 100. For example, a rotation of second end 104 relative to the lipstick could change a relative disposition of the lipstick refill within second end 104.

Case 100, first end 102, and second end 104 could be made of the same materials or of a combination of different materials. For example, case 100, parts of case 100, first end 102, and second end 104 could be made of synthetic rubber, natural rubber, silicone, nylon, leather, canvas, polypropylene, polyurethane, polyethylene, polyvinyl chloride (PVC), polytetrafluoroethylene (PTFE), polyester, high-gloss polyester, plastic, metal, glass, polymer, other suitable materials, or any combination thereof.

In one embodiment, case 100, parts of case 100, first end 102, and second end 104 could be treated, coated, or embellished with a finish, paint, metallic material, plastic, rubber, silicone, lacquer, engraving, color, emblem, logo, trademark, ergonomic feature, structural feature, decorative item, jewel, semi-precious stone, diamond, gold, silver, platinum, stone, ceramic, mirror, light, light emitting diode (LED), magnifying glass, magnet, clip, handle, retaining device, other suitable materials, or any combination thereof.

Accessory 106 could include one or more of any suitable accessory such as, for example, a magnifying glass, brush, brush attachment, magnet, light, mirror, lighted mirror, blotting papers, writing utensil, key chain, any other suitable accessory, or any combination thereof. It should be understood that case 100 could include other removable or permanent elements as decorative or functional accessories either attached to, removably attached to, or generally associated with case 100. In addition, accessory 106 could be any suitably sized, shaped, or configured accessory located on case 100 as shown in FIG. 1 or in any suitable location on or associated with case 100.

Edge 108 could include a rigid or semi-rigid structure having a tapered or non-tapered edge configured to couple with an open end of first end 102. In one embodiment, edge 108 could include a seal-like structure (e.g., a rubber seal, overlay, or other structure) between first end 102 and second end 104 when in an engaged position. Although edge 108 is shown in a particular configuration in FIG. 1 (and more particularly shown in FIGS. 2A, 2B, and 2C), it should be understood that edge 108 could include any suitably sized, shaped, or configured structure to couple with an open end of first end 102. In addition, it should be understood that edge 108 could be made of the same material or combination of materials used for second end 104, or any other suitable material or combination of materials.

Figure 2A:
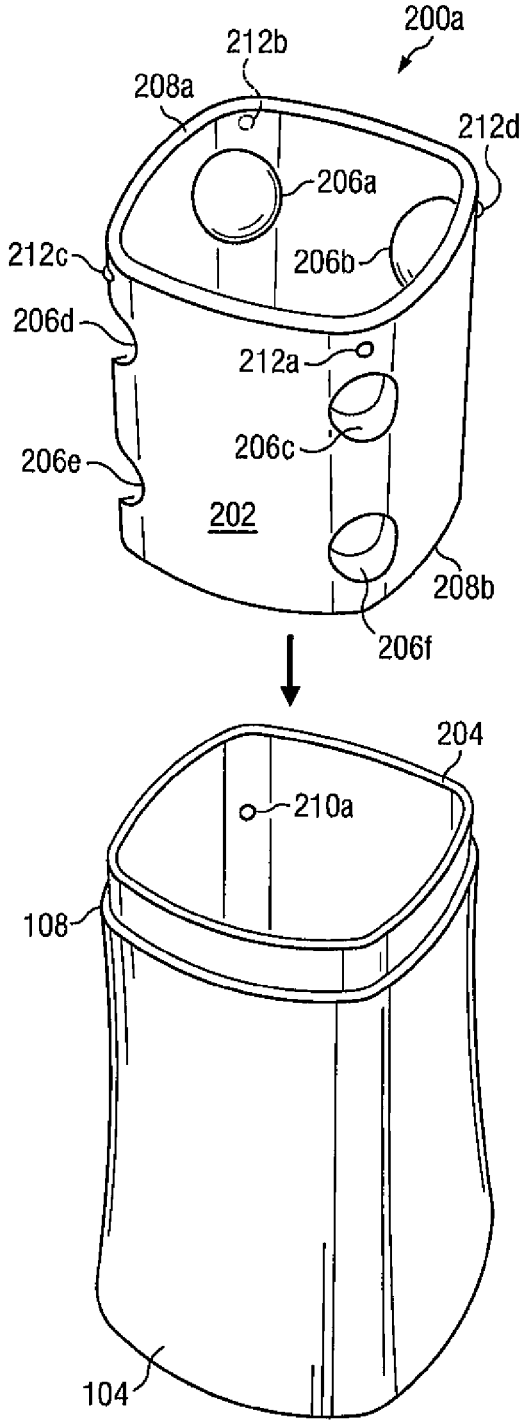
FIG. 2A is somewhat simplified exploded view of the reusable case shown in FIG. 1 relative to an insert for the case according to one embodiment of the present disclosure.
Figure 2B:
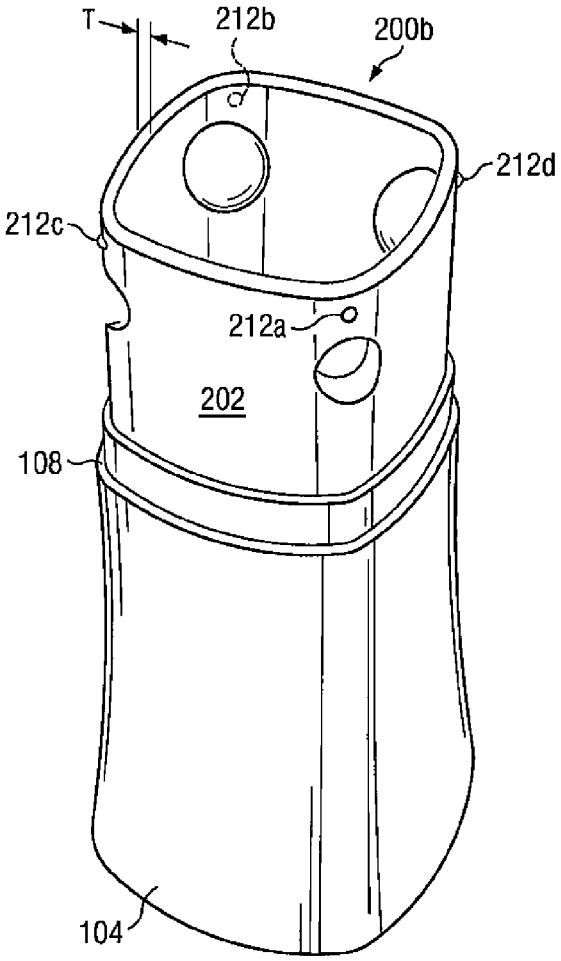
FIG. 2B is a somewhat simplified illustration of the insert shown in FIG. 2A in a partially engaged position relative to a second end of the reusable case according to one embodiment of the present disclosure.
Figure 2C:
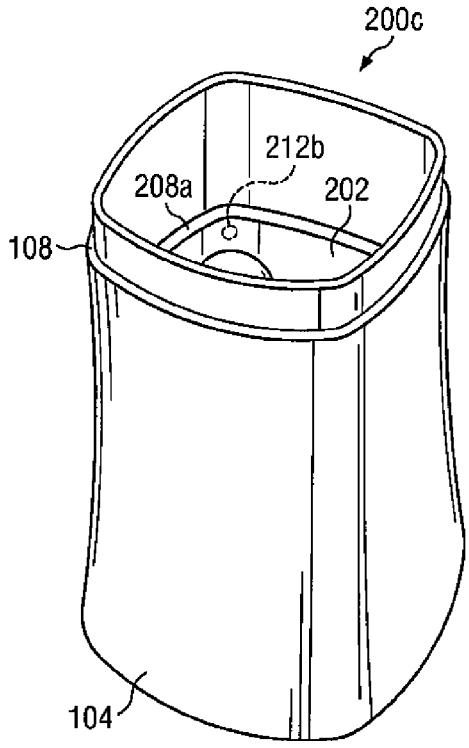
FIG. 2C is a perspective view of the reusable case shown in FIG. 1 in a fully engaged position relative to the insert shown in FIG. 2A according to one embodiment of the present disclosure.

FIGS. 2A, 2B, and 2C are somewhat simplified exploded and perspective views of second end 104 and insert 202. More particularly, FIG. 2A is a somewhat simplified exploded view of case 100 relative to insert 202. FIG. 2B is a somewhat simplified illustration of insert 202 in a partially engaged position relative to second end 104. FIG. 2C is a perspective view of one embodiment of case 100 shown with insert 202 in a fully engaged position. It should be understood that second end 104 and insert 202 shown in FIGS. 2A, 2B, and 2C are for illustrative purposes only and that any other suitable system or subsystem could be used in conjunction with or in lieu of second end 104 and insert 202 according to one embodiment of the present disclosure. In one embodiment, for example, case 100 and second end 104 shown in FIGS. 2A, 2B, and 2C could include each feature described above and further include a flange or lip 204 and one or more notches such as notch 210*a*.

Lip 204 could include a rigid or semi-rigid structure having a tapered or non-tapered edge configured to couple with an open end of first end 102. In one embodiment, lip 204 could include a seal-like structure (e.g., a rubber seal, overlay, or other structure) between first end 102 and second end 104 when in an engaged position. Although lip 204 is shown in a particular configuration in FIGS. 2A, 2B, and 2C, it should be understood that lip 204 could include any suitably sized, shaped, or configured structure to couple with an open end of first end 102. In addition, it should be understood that lip 204 could be made of the same material or combination of materials used for second end 104, or any other suitable material or combination of materials.

Insert 202 could include a generally semi-rigid structure having a tapered or non-tapered body configured to couple with the interior surface of second end 104. In one embodiment, insert 202 could provide a removable (or permanent) liner-like structure for case 100 disposed between an external surface of insert 202 and an internal surface of second end 104. As an example, insert 202 could be suitably shaped, sized, and configured to aid in retaining, securing, or otherwise disposing a lipstick refill within second end 104.

Figure 3:
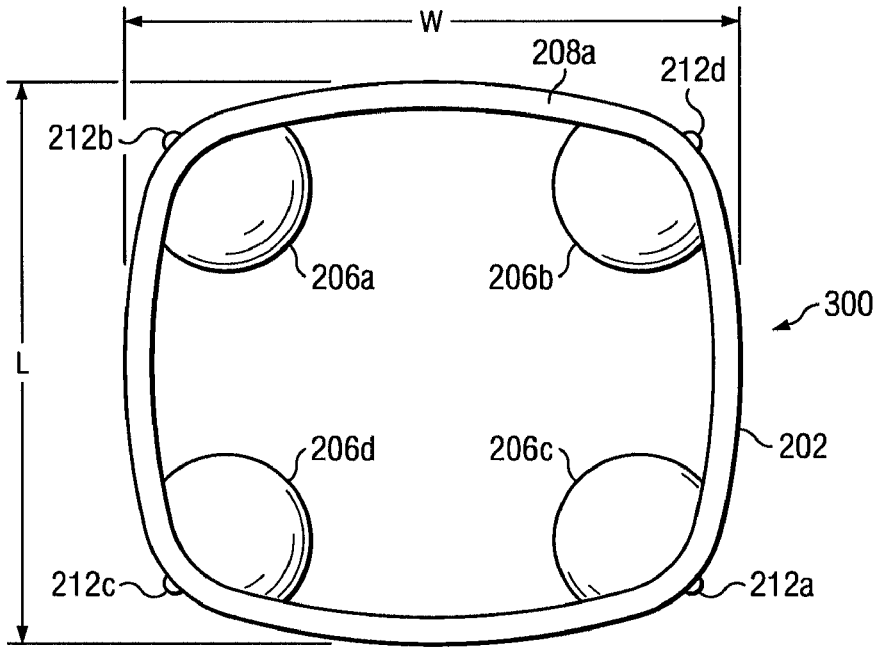
FIG. 3 is an exemplary top plan view of the insert shown in FIG. 2A according to one embodiment of the present disclosure.
Figure 4:
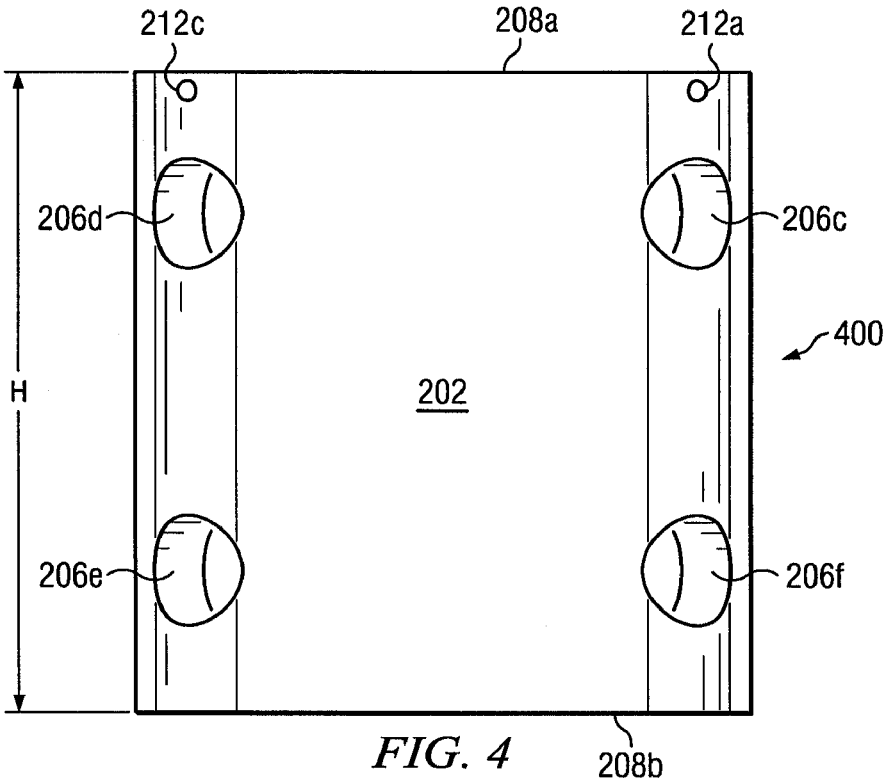
FIG. 4 is an exemplary side plan view of the insert shown in FIG. 3 according to one embodiment of the present disclosure.

Although insert 202 is shown in a particular configuration in FIGS. 2A, 2B, and 2C, it should be understood that insert 202 could include any thickness (T) or any suitably sized, shaped, or configured structure to couple with an interior surface of second end 104. For example, FIG. 3 is an exemplary top plan view of insert 202, while FIG. 4 is an exemplary side plan view of insert 202 shown in FIG. 3. In one embodiment, the size and shape of insert 202 could be customized to help accommodate different sized and shaped lipstick refills within case 100.

Insert 202 could be made of any suitable material including, for example, synthetic rubber, natural rubber, silicone, nylon, leather, canvas, polypropylene, polyurethane, polyethylene, polyvinyl chloride (PVC), polytetrafluoroethylene (PTFE), polyester, high-gloss polyester, plastic, metal, glass, polymer, other suitable materials, or any combination thereof.

In one embodiment, insert 202 could include protrusions 206*a*, 206*b*, 206*c*, 206*d*, 206*e*, and 206*f* (collectively referred to herein as protrusions 206), top edge 208*a*, bottom edge 208*b*, and projections 212*a*, 2126, 212*c*, and 212*d* (collectively referred to herein as projections 212), as generally shown in FIGS. 2A, 2B, 2C, 3, and 4.

Protrusions 206 could include a somewhat dome-shaped, dimple-like structures having a convex portion on an internal surface of insert 202. The convex portions of protrusions 206 could include semi-rigid structures that aid in retaining a particular disposition of, for example, a lipstick refill disposed within second end 104. In one embodiment, the convex portion of protrusions 206 could be made of rubber or other material to provide a suitable amount of friction to a lipstick refill or an associated tube when disposed within second end 104. The size and shape of protrusions 206 could be customized to help accommodate different sized and shaped lipstick refills within case 100. In one embodiment, protrusions 206 could include complementary concave portions on an external surface of insert 202 for each convex portion described above as generally shown in FIGS. 2A, 2B, 2C, and 4.

Although FIGS. 2A, 2B, 2C, 3, and 4 illustrate six protrusions 206 on insert 202, it should be understood that any suitable number of protrusions could be used in accordance with the present disclosure. In addition, insert 202 and protrusions 206 could be made of any suitable material or combination of materials including, for example, silicone, rubber, semi-rigid, pliable material, or any combination thereof.

Projections 212 could generally mate with one or more notches 210*a* (shown in, for example, FIG. 2A). Projections 212 could generally include a somewhat dome-shaped, dimplelike structure having a convex portion on an external surface of insert 202. The convex portions of projections 212 could include semi-rigid structures that aid in retaining a particular disposition of, for example, insert 202 within second end 104 by mating with or otherwise disposing within one of projections 212 (for example, groove 212*b*) with notch 210*a* (as generally shown in FIGS. 2B and 2C). It should be understood that although only one notch 210*a* is shown in FIG. 2A, any suitable number, size, shape, or configuration of notch 210*a* (and any pairings between a notch 210*a* and projection 212) could be used in accordance with the present disclosure. It should also be understood that any other similar mechanism could be used in lieu of or in combination with notch 210*a* and projection 212. For example, notch 210*a* could be located on an external surface of insert 202, while projection 212 could be located on an internal surface of case 100.

In one embodiment, a convex portion of projections 212 could be made of rubber or other material to maintain a relative position between insert 202 and an internal surface of second end 104. In one embodiment, projections 212 could include complementary concave portions on an internal surface of insert 202 for each convex portion described above as generally shown in FIGS. 2B and 2C, and 4.

Accordingly, case 100 provides a reusable, removable, and adjustable "case" to securely house a personal item such as, for example, a lipstick refill. For example, as generally shown in FIGS. 2A and 2C, when insert 202 is in a fully engaged position within second end 104, the disposition of insert 202 is maintained in part by a mating disposition between notch 210*a* and projection 212*b*. Similarly, when a lipstick refill is properly positioned within second end 104, the disposition of the lipstick refill is maintained in part by a mating disposition between a convex portion of protrusions 206 with an external surface of the lipstick refill.

Figure 5:
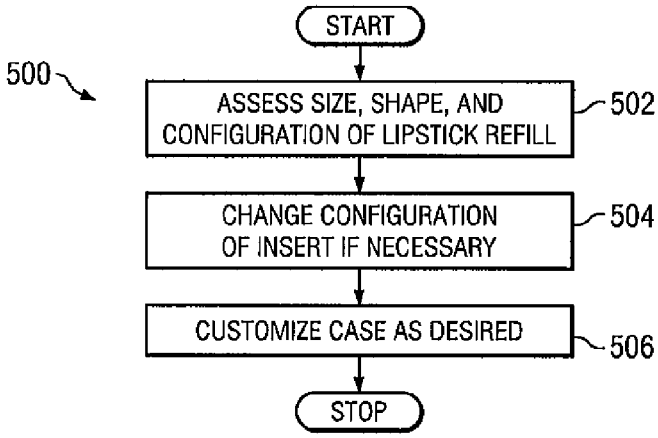
FIG. 5 is a somewhat simplified flow diagram illustrating a method of providing a custom universal case for a lipstick refill according to one embodiment of the present disclosure.

FIG. 5 is a somewhat simplified flow diagram illustrating method 500 of providing a custom universal case for a lipstick refill according to one embodiment of the present disclosure. It should be understood that method 500 shown in FIG. 1 is for illustrative purposes only and that any other suitable method or sub-method could be used in conjunction with or in lieu of method 500 according to one embodiment of the present disclosure. It should also be understood that the steps and sub-steps of method 500 could be performed in any suitable order.

In step 502, the size and shape of the lipstick refill and any associated lipstick tube are assessed according to one embodiment of the present disclosure. Depending on the data collected in step 502, the size and shape of an insert such as, for example, insert 202 shown in FIG. 2A, or protrusions on the insert such as, for example, protrusions 206 sown in FIG. 3, could be changed or altered to accommodate the lipstick refill and any associated lipstick tube within a universal case such as, for example, case 100 shown in FIG. 1.

As an example, the size or shape of insert 202 could be changed in step 504 to provide a fully engaged position within second end 104. As another example, the mating disposition between a convex portion of protrusions 206 with an external surface of the lipstick refill could be changed to provide better retention and placement of the lipstick refill within second end 104.

In step 506, the color, size, dimension, shape, and associated accessories and embellishments for case 100 are customized according to specifications from the manufacturer, distributor, retailer, marketing group, customer, end user, other suitable entity or person, or any combination thereof. For example, case 100 could be customized in step 506 to include certain shapes, configurations, finishes, paints, metallic materials, plastics, rubbers, silicones, lacquers, engravings, colors, emblems, logos, trademarks, ergonomic features, structural features, decorative items, jewels, semi-precious stones, diamonds, gold, silver, platinum, stones, ceramics, mirrors, lights, light emitting diodes (LEDs), magnifying glasses, magnets, clips, handles, retaining devices, other suitable materials, or any combination thereof.

Accordingly, method 500 could provide a method of providing a custom reusable, removable, and adjustable case 100 to securely house a personal item such as, for example, a lipstick refill according to one embodiment of the present disclosure. For example, case 100 could include functional as well as decorative features as desired by the manufacturer, distributor, retailer, marketing group, customer, end user, other suitable entity or person, or any combination thereof.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A universal case for a lipstick refill, the lipstick refill having a base and a lipstick color, the case comprising:

an elongated tube having a first end and a second end;

an insert removably disposed within the second end to retain the lipstick refill; and a plurality of circumferential rows of semi-rigid, dome-shaped protrusions disposed along a length of an interior surface of the insert;

wherein the protrusions frictionally grippingly engage the base of the lipstick refill.

2. The universal case of claim 1, wherein the second end comprises a projection to receive a groove disposed on an exterior surface of the insert.

3. The universal case of claim 1, wherein the elongated tube comprises a mirror.

4. The universal case of claim 1, wherein the elongated tube comprises a light.

5. The universal case of claim 1, wherein the elongated tube comprises a generally square cross-sectional shape.

6. The universal case of claim 1, wherein the case is reusable.

7. The universal case of claim 1, wherein the insert is operable to retain a variety of different sizes and types of lipstick refills.

8. A universal case for a lipstick refill, the lipstick refill having a lipstick color and a base portion with a twist-up mechanism, the case comprising:

an elongated tube having a first end and a second end;

an insert removably disposed within the second end:

a plurality of circumferential rows of semi-rigid, dome-shaped protrusions spaced apart and extending inwardly along a length of an interior surface of the insert to frictionally grippingly engage the base portion of the lipstick refill;

wherein a rotation of the second end and insert that grippingly engages the base portion of the lipstick refill operates the twist-up mechanism and changes a relative disposition of the lipstick color within the elongated tube.

9. The universal case of claim 8, wherein the elongated tube comprises at least one of: a mirror and a light.

10. The universal case of claim 8, wherein the elongated tube comprises a generally square cross-sectional shape.

11. The universal case of claim 8, wherein the case is reusable.

12. The universal case of claim 8, wherein the elongated tube is operable to house a variety of different sizes and types of lipstick refills.

13. A universal case for a lipstick refill, the lipstick refill having a base and a lipstick color, the case comprising:

an elongated tube to house a lipstick refill;

a projection disposed on an interior surface of the elongated tube to receive a groove disposed on an exterior surface of an insert removably disposed within a second end of the elongated tube; and a plurality of circumferential rows of semi-rigid, dome-shaped protrusions disposed along a length of an interior surface of the insert, the plurality of protrusions frictionally grippingly engaging the base of the lipstick refill.

14. The universal case of claim 13, wherein the elongated tube comprises a generally square cross-sectional shape.

15. The universal case of claim 13, wherein the case is reusable.

16. The universal case of claim 13, wherein the elongated tube is operable to house a variety of different sizes and types of lipstick refills.

* * * * *

UNITED STATES PATENT AND TRADEMARK OFFICE

CERTIFICATE OF CORRECTION

PATENT NO. : 8,210,347 B2
APPLICATION NO. : 12/683373
DATED : July 3, 2012
INVENTOR(S) : Olive Anne McLaughlin It is certified that error appears in the above-identified patent and that said Letters Patent is hereby corrected as shown below:

In column 6, line 10, please replace "FIG. 1" with --FIG. 5--.

Signed and Sealed this
Twenty-fifth Day of September, 2012

David J. Kappos

David J. Kappos
*Director of the United States Patent and Trademark Office*